US009353446B2

(12) United States Patent
Mulcahy et al.

(10) Patent No.: US 9,353,446 B2
(45) Date of Patent: May 31, 2016

(54) SYSTEMS AND METHODS FOR IMPRESSED CURRENT CATHODIC PROTECTION

(71) Applicant: Transistor Devices, Inc., Hackettstown, NJ (US)

(72) Inventors: Gary Mulcahy, Flanders, NJ (US); John Santini, Columbia, NJ (US)

(73) Assignee: Transistor Devices, Inc., Hackettstown, NJ (US)

( * ) Notice: Subject to any disclaimer, the term of this patent is extended or adjusted under 35 U.S.C. 154(b) by 94 days.

(21) Appl. No.: 14/264,982

(22) Filed: Apr. 29, 2014

(65) Prior Publication Data

US 2014/0318984 A1 Oct. 30, 2014

Related U.S. Application Data

(60) Provisional application No. 61/817,004, filed on Apr. 29, 2013, provisional application No. 61/930,160, filed on Jan. 22, 2014.

(51) Int. Cl.
*B01D 59/40* (2006.01)
*C23F 13/04* (2006.01)

(52) U.S. Cl.
CPC ..... *C23F 13/04* (2013.01)

(58) Field of Classification Search
CPC ..... C23F 13/00; C23F 13/02
USPC ..... 307/95
See application file for complete search history.

(56) References Cited

U.S. PATENT DOCUMENTS 4,175,021 A 11/1979 Tatum et al.
4,400,259 A 8/1983 Schutt (Continued)

FOREIGN PATENT DOCUMENTS

EP 0448963 A1 10/1991
EP 1777322 A1 4/2007

(Continued)

OTHER PUBLICATIONS

Bushman, James B., "Impressed Current Cathodic Protection System Design", Bushman & Associates, Inc., 17 pages, Jan. 2013. Available at http://www.bushman.cc/pdf/impressed_current_system_design.pdf.

Peabody, A.W., "Peabody's Control of Pipeline Corrosion: Second Edition", NACE International, 247 pages, 2001.

Peratta et al., "Computer Modeling of Impressed Current Cathodic Protection (ICCP) System Anodes", Proceedings of the ASME 2009 International Design Engineering Technical Conferences & Computers and Information in Engineering Conference, 8 pages, 2009.

(Continued)

*Primary Examiner* — Daniel Cavallari
(74) *Attorney, Agent, or Firm* — Brown & Michaels, PC

(57) ABSTRACT

In some embodiments, an ICCP system includes an AC-DC rectifier receiving AC power from an AC power source and providing a DC output having a constant voltage or a constant current, a cathode connection electrically coupling the AC-DC rectifier to a structure to be protected by the ICCP system, current-emitting anodes arranged in parallel and receiving the DC output from the AC-DC rectifier, and a controller communicating with the AC-DC rectifier to set a maximum value for the constant voltage or constant current of the DC output. In other embodiments, an ICCP system includes a converter assembly including an AC-DC rectifier and a rectifier chassis enclosing and environmentally sealing the AC-DC rectifier. The ICCP system also includes an environmentally-sealed controller communicating with the AC-DC rectifier and an environmentally-protected Input-Output connection assembly. Junctions electrically connect the converter assembly, the environmentally-sealed controller, and the environmentally-protected connection assembly.

10 Claims, 6 Drawing Sheets

(56) References Cited

U.S. PATENT DOCUMENTS

| | | | | |
|---|---|---|---|---|
| 6,469,918 | B1 * | 10/2002 | Abramski | C23F 13/04 205/726 |
| 7,186,321 | B2 * | 3/2007 | Benham | C23F 13/04 204/196.1 |
| 7,438,787 | B2 | 10/2008 | Mizuno et al. | |
| 8,298,382 | B2 | 10/2012 | Hanlon et al. | |
| 2003/0173231 | A1 | 9/2003 | Schneck et al. | |
| 2006/0203411 | A1 * | 9/2006 | Fourie | C23F 13/04 361/115 |
| 2007/0187854 | A1 * | 8/2007 | Sirola | C04B 28/04 264/35 |
| 2008/0105562 | A1 * | 5/2008 | Simpson | C23F 13/02 205/724 |
| 2009/0138148 | A1 * | 5/2009 | Deivasigamani | C23F 13/04 701/21 |
| 2012/0305386 | A1 * | 12/2012 | Schutt | C23F 13/16 204/196.38 |

FOREIGN PATENT DOCUMENTS

| | | | |
|---|---|---|---|
| WO | 01/14614 | A2 | 3/2001 |
| WO | 2004009436 | A1 | 1/2004 |

OTHER PUBLICATIONS

Vukcevic, R., "A Novel 'Green' Approach to Powering Marine ICCP Systems", Corrosion & Prevention 2008 Conference, 18 pages, 2008.

Vukcevic et al., "Improving Anode Loop Energy Efficiency of Marine ICCP Systems", Corrosion & Prevention 2009 Conference, 11 pages, 2009.

Vukcevic et al., "Resolving CP Design Restrictions at an Australian Wharf: A Novel Marine Impressed Current CP System", Corrosion 2010, NACE International, abstract only, 1 page, 2010.

International Search Report and Written Opinion for PCT/US2014/035868, dated Nov. 25, 2014, 9 pages.

* cited by examiner

SYSTEMS AND METHODS FOR IMPRESSED CURRENT CATHODIC PROTECTION

REFERENCE TO RELATED APPLICATIONS

This application claims one or more inventions which were disclosed in Provisional Application No. 61/817,004, filed Apr. 29, 2013, entitled "SYSTEM FOR IMPRESSED CURRENT CATHODIC PROTECTION". The benefit under 35 USC §119(e) of the United States provisional application is hereby claimed, and the aforementioned application is hereby incorporated herein by reference.

This application also claims one or more inventions which were disclosed in Provisional Application No. 61/930,160, filed Jan. 22, 2014, entitled "SYSTEM FOR IMPRESSED CURRENT CATHODIC PROTECTION". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of corrosion protection of structures. More particularly, the invention pertains to methods and apparatus for protection of structures against corrosion using impressed cathodic current.

2. Description of Related Art

Oftentimes metal structures are protected from the effects of environmentally-sourced corrosion through the implementation of Impressed Current Cathodic Protection ("ICCP") systems. Conventional deployment of these systems is realized with an open loop control topology, where the DC power source (i.e., the "ICCP Rectifier") output potential is fixed based on a manual survey of the structure to determine appropriate protection levels. FIG. 1 presents a typical prior art deployment scenario for a well casing cathodic protection system 10.

The well casing 12 extends into the ground with a well head 14 extending above ground level 16 from the well casing 12. A cathode junction box 20 is located at or above ground level 16 and is coupled to the well head 14 by a negative connection 22. The cathode junction box 20 is also coupled to a pole-mounted cathodic protection rectifier 30 by a second negative connection 24. The cathodic protection rectifier 30 is also coupled to an anode junction box 40 by a positive connection 42. The anode junction box 40 is also coupled to a deep anode bed 50 by another positive connection 44. The deep anode bed 50 includes backfill 52 that is electrically conductive and a plurality of anodes 54 extending down the center of the deep anode bed 50 through the backfill 52.

The deep anode bed is often of the type sold under the trademark EnvirAnode® with AEL™ anodes and Conducrete® backfill (SAE, Inc., Barrie, Ontario, Canada).

A major limitation of this approach is that it does not account for seasonal variations in surrounding media electrical resistance. This limitation forces the system operator to manually check the system's performance on a regular basis and implement a manual readjustment of the system's output voltage to its optimal value.

Conventional systems also do not prevent certain sections of the structure from being "over-protected" due to local surrounding media electrical resistance variations. This can result in potential structure embrittlement and ultimate compromise.

The conventional practice is to utilize utility line frequency transformers, followed by discrete rectification and filtering components to realize the DC power source required to implement an ICCP system. These components are typically housed in an environmentally-sealed cabinet that protects the circuitry from external environmental effects.

More often than not, these conventional systems do not employ an automatic, closed-loop feedback system to regulate output power, but instead rely on manual setting of output power (voltage and/or current) via taps on the transformer. These conventional systems also present challenges for field maintainability, requiring technicians to troubleshoot and repair circuits to the component level if there is a failure, thus presenting issues with regard to training and safety of personnel, as well as the potential for excessive equipment down time.

Vukcevic ("A Novel 'Green' Approach to Powering Marine ICCP Systems", presented at Corrosion & Prevention 2008 Conference, Wellington, New Zealand, Nov. 16-19, 2008) discloses a DC power distribution system incorporating Current Multiplier DC/DC converters (CM-PDS) in the construction of sea water ICC systems. The disclosed CM-PDS system approach has a modular structure, based on standardized building blocks. A major feature of the disclosed approach is dual power transformation before DC current reaches the anodes, as a high voltage distribution network is introduced between the AC/DC power supplies and Current Multiplier converters feeding the anodes. By distributing high voltage/low currents, the low voltage distribution cable network is eliminated as a major source of power losses associated with ICCP.

The above-mentioned reference is hereby incorporated by reference herein.

SUMMARY OF THE INVENTION

In some embodiments, an ICCP system includes an AC-DC rectifier receiving AC power from an AC power source and providing a DC output having a constant voltage or a constant current, a cathode connection electrically coupling the AC-DC rectifier to a structure to be protected by the ICCP system, current-emitting anodes arranged in parallel and receiving the DC output from the AC-DC rectifier, and a controller communicating with the AC-DC rectifier to set a maximum value for the constant voltage or constant current of the DC output. In other embodiments, an ICCP system includes a converter assembly including an AC-DC rectifier and a rectifier chassis enclosing and environmentally sealing the AC-DC rectifier. The ICCP system also includes an environmentally-sealed controller communicating with the AC-DC rectifier and an environmentally-protected Input-Output connection assembly. Junctions electrically connect the converter assembly, the environmentally-sealed controller, and the environmentally-protected connection assembly.

DETAILED DESCRIPTION OF THE INVENTION

In some embodiments, an ICCP system utilizes an advanced, high-frequency switch-mode converter to realize the AC-DC power conversion function and closed-loop control. The rectifier is implemented in a fully environmentally-sealed fashion such that it may be deployed in any number of exposed end locations and still be easily field-maintainable. The system also features electronic, closed-loop control of the delivered power and extensive surge protection on both input and output circuits to assure reliability in environmentally-exposed conditions.

A high-efficiency, switch-mode AC-DC rectifier provides closed-loop, precision control of the total current delivered to the structure being protected.

Figure 1:
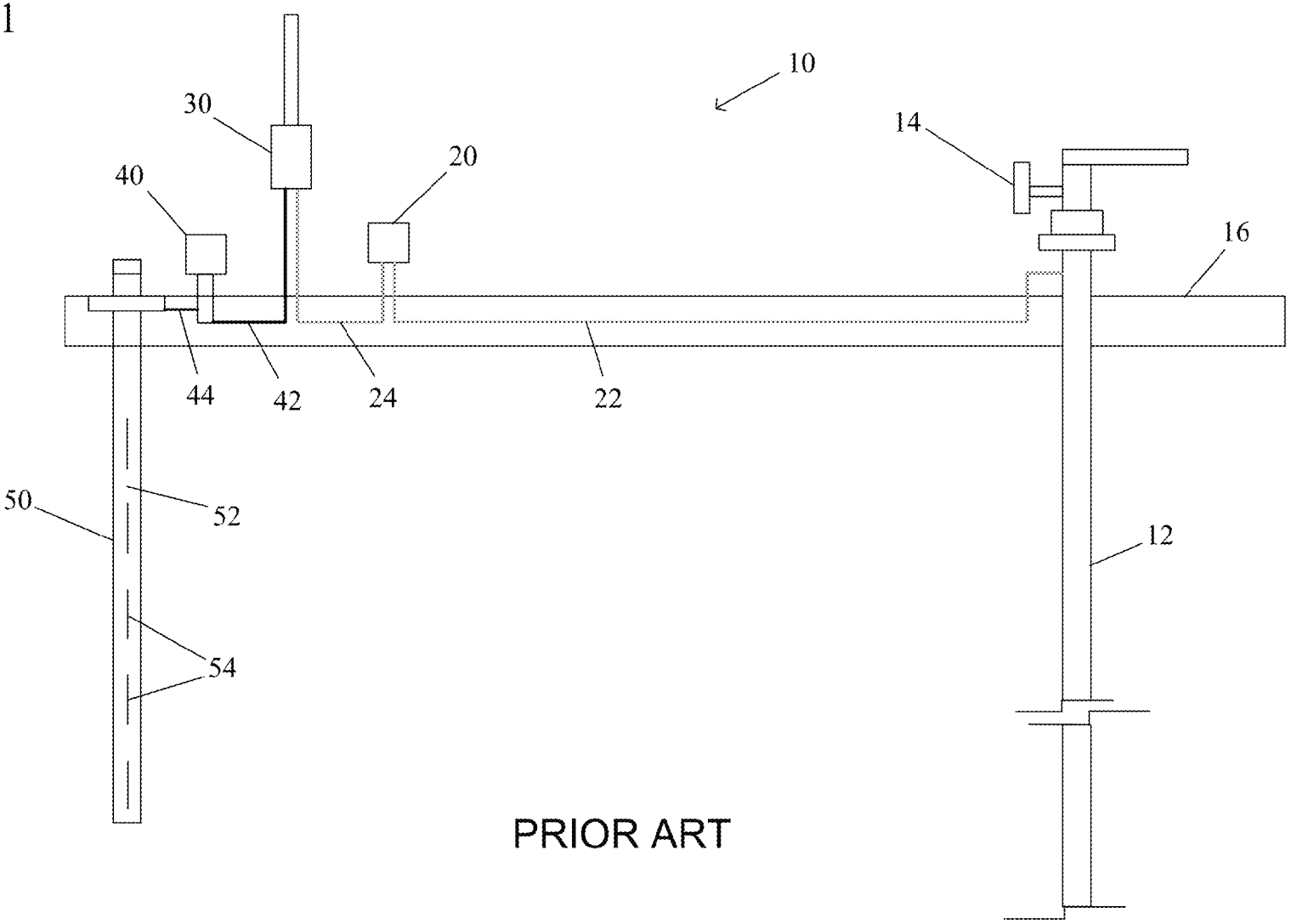
FIG. 1 shows a prior art well casing cathodic protection system.
Figure 2:
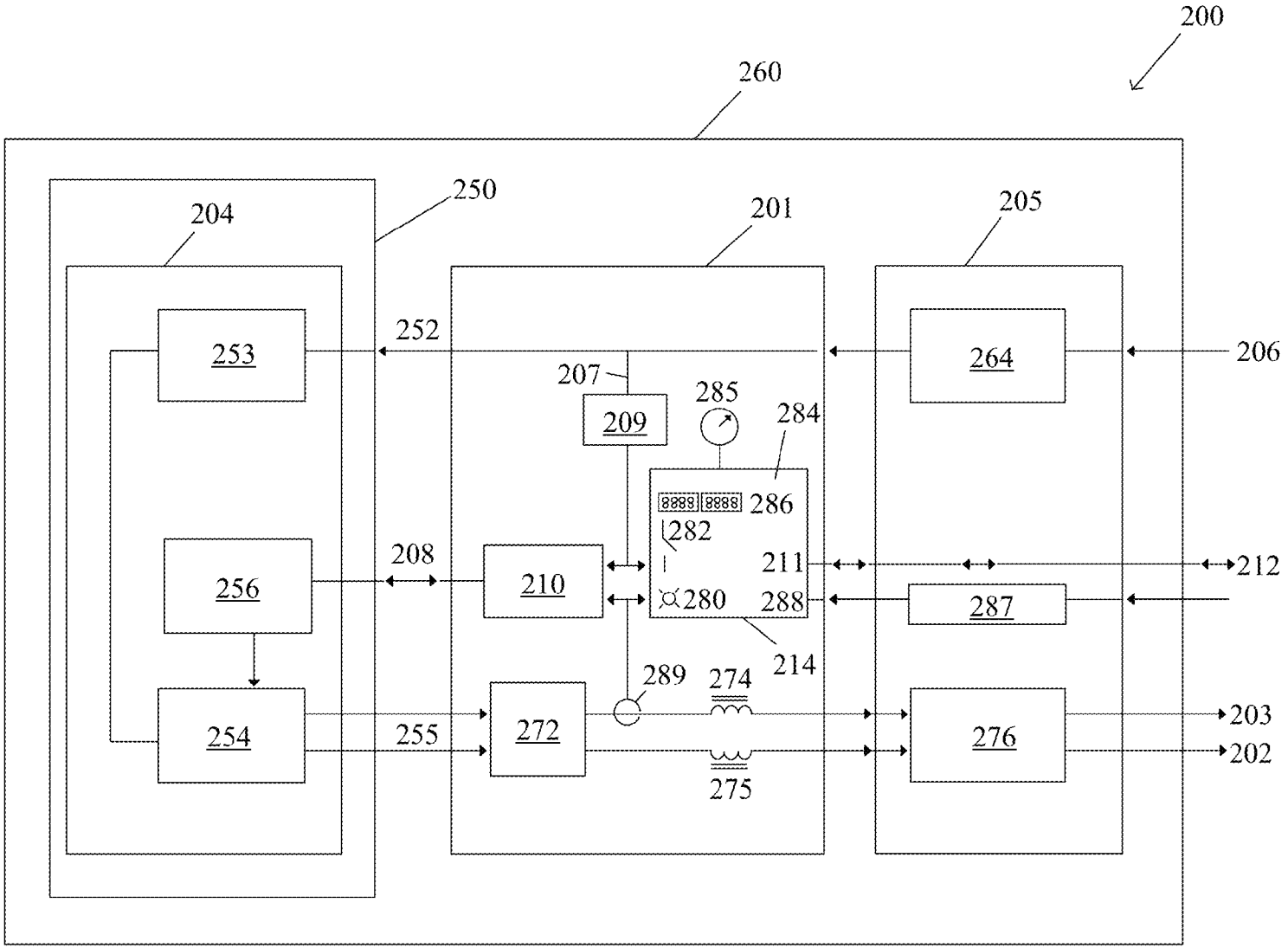
FIG. 2 shows a block diagram of an ICCP system in an embodiment of the present invention.

Referring to FIG. 2, the structure to be protected (not shown) is coupled by a remote cathode connection 202 to an AC-DC power converter 204 of the ICCP system 200. The AC-DC power converter 204 is preferably field-replaceable and is housed in a converter enclosure 250, which is environmentally sealed. The environmentally-sealed enclosure 250 is electrically coupled to a control box assembly 201 by sets of cables 208, 252, 255. AC power is supplied to the control box assembly 201 via an Input-Output connection assembly 205, which is fed by an AC power line 206. The AC-DC power converter 204 receives AC power by way of the AC power line 252, which interfaces to surge suppression network 253, and provides a constant voltage or current output via a power processing circuit 254. The AC-DC power converter 204 is coupled to an ICCP controller 210 in the control box assembly 201 by a control line 208, which interfaces via a rectifier internal control and reporting circuit 256. The AC power line 206 also provides power to the ICCP controller 210 through a power line 207 off the rectifier power line 252, and a controller power supply 209. The ICCP controller 210 communicates through the control line 208, which connects to rectifier internal control block 256 to set the maximum system current that is output by the AC-DC power converter 204. The control box assembly 201, the Input-Output connection assembly 205, and the converter enclosure 250 are housed in a cabinet 260, providing solar shielding, resistance to tampering, and resistance to vermin and which may or may not be otherwise environmentally-sealed.

The control box assembly 201 is preferably environmentally sealed and contains the ICCP controller 210, a current sensor 289, and a low current lightning arrestor 272, along with surge current limiting chokes 275, 274 on the remote cathode and anode connection lines 202, 203, respectively. The ICCP controller 210 may be accessed by a user through either a digital user interface 212 by way of an Ethernet interface 211 or a local RS232 user interface 214.

The ICCP controller 210 also includes a local manual interface 284, which preferably includes a DC power enable switch 282, a lockable current adjustment knob 285, local meters 286 to measure the voltage and current being output by the AC-DC power converter 204, an optional reference cell measurement interface 288, and an alarm indicator 280, which preferably includes a red LED light.

Power is transmitted to and from the AC-DC power converter 204 via the Input-Output connection assembly 205. This contains high current lightning surge arrestors 264, 276, 287 for the AC input, DC output, and optional reference cell measurement circuit, respectively. The combination of high current surge arrestors in the Input-Output connection assembly 205, and additional low current surge arrestors located in control box assembly 201 and AC-DC power converter 204, along with surge current limiting chokes 274, 275 provides a layered surge arrestor topology so as to provide enhanced lightning surge protection.

The improved ICCP system includes three major assemblies: an environmentally-sealed AC-DC power converter enclosure 250 (referred to as a "rectifier"), a second environmentally-sealed module for the ICCP controller 210 that provides a user with an interface, including input and output port surge protection, input power control, and output power control; and a third environmentally protected assembly 205 that provides input-output interface and surge suppression.

Environmentally sealing may include, but is not limited to, one or more of electrically sealing, water-tight sealing, air-tight sealing, and thermally protecting the contents from the external environment.

The ICCP system is housed in a cabinet that provides solar shielding and protection against vandalism and vermin. This cabinet houses a fully environmentally sealed AC-DC rectifier module. This module is realized by encapsulating the electronic components in an oil-filled, sealed chassis. Oil provides effective thermal coupling between the irregularly shaped, heat-dissipating electronic components and the external chassis skin.

Figure 3:
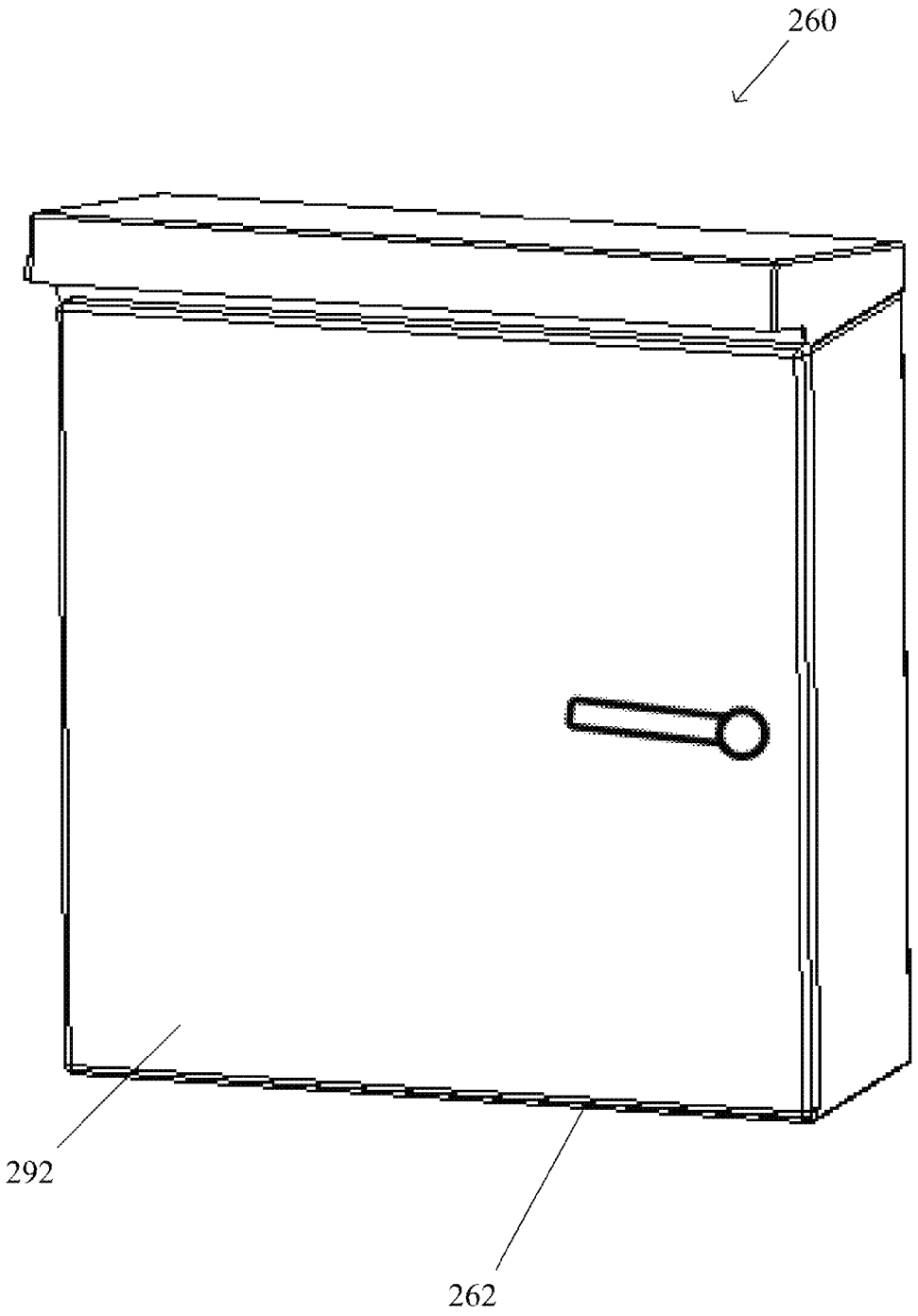
FIG. 3 shows schematically a first perspective view of the ICCP system of FIG. 2.
Figure 4:
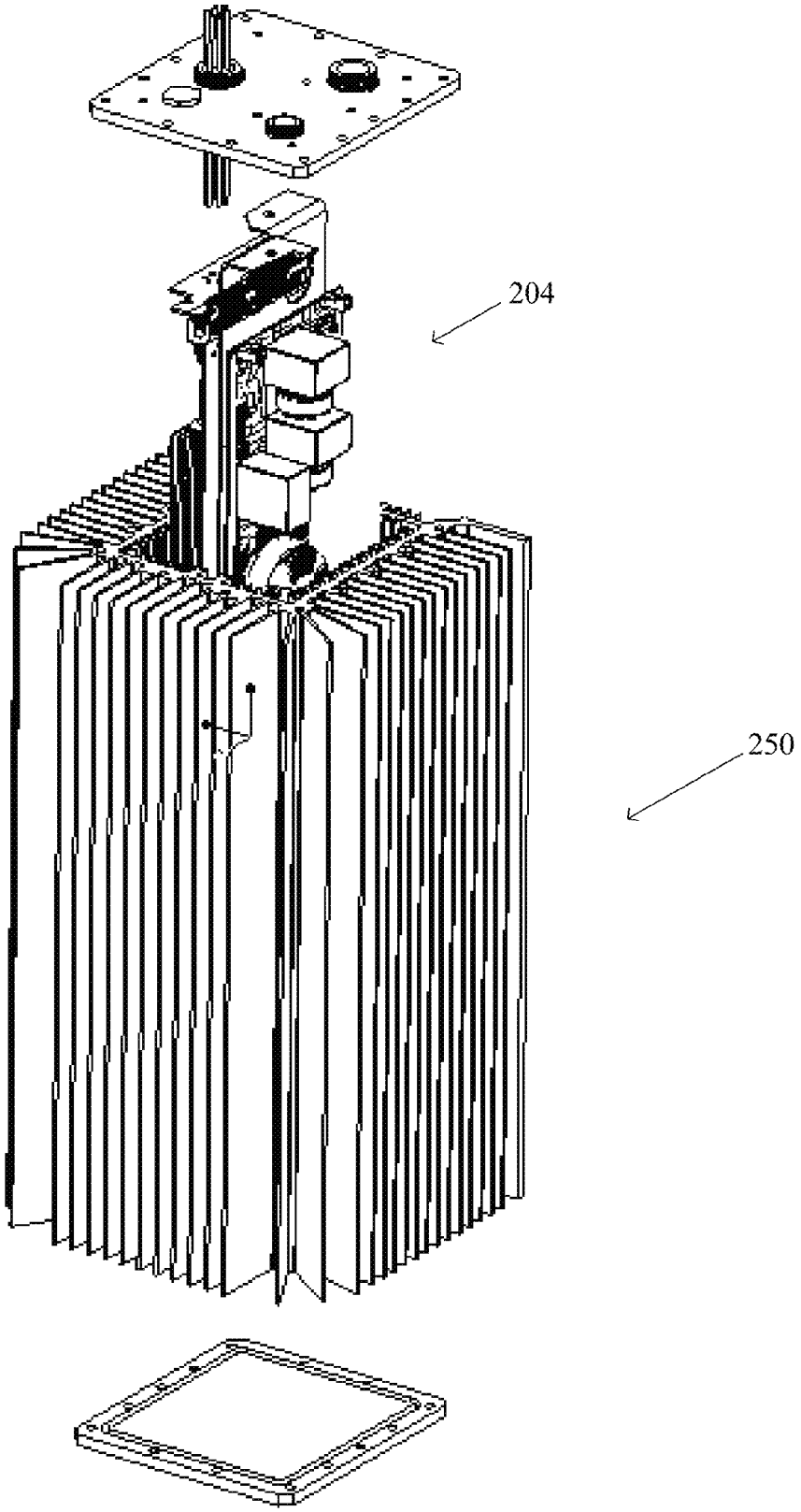
FIG. 4 shows schematically a perspective view of the rectifier module of the ICCP system of FIG. 2.
Figure 5:
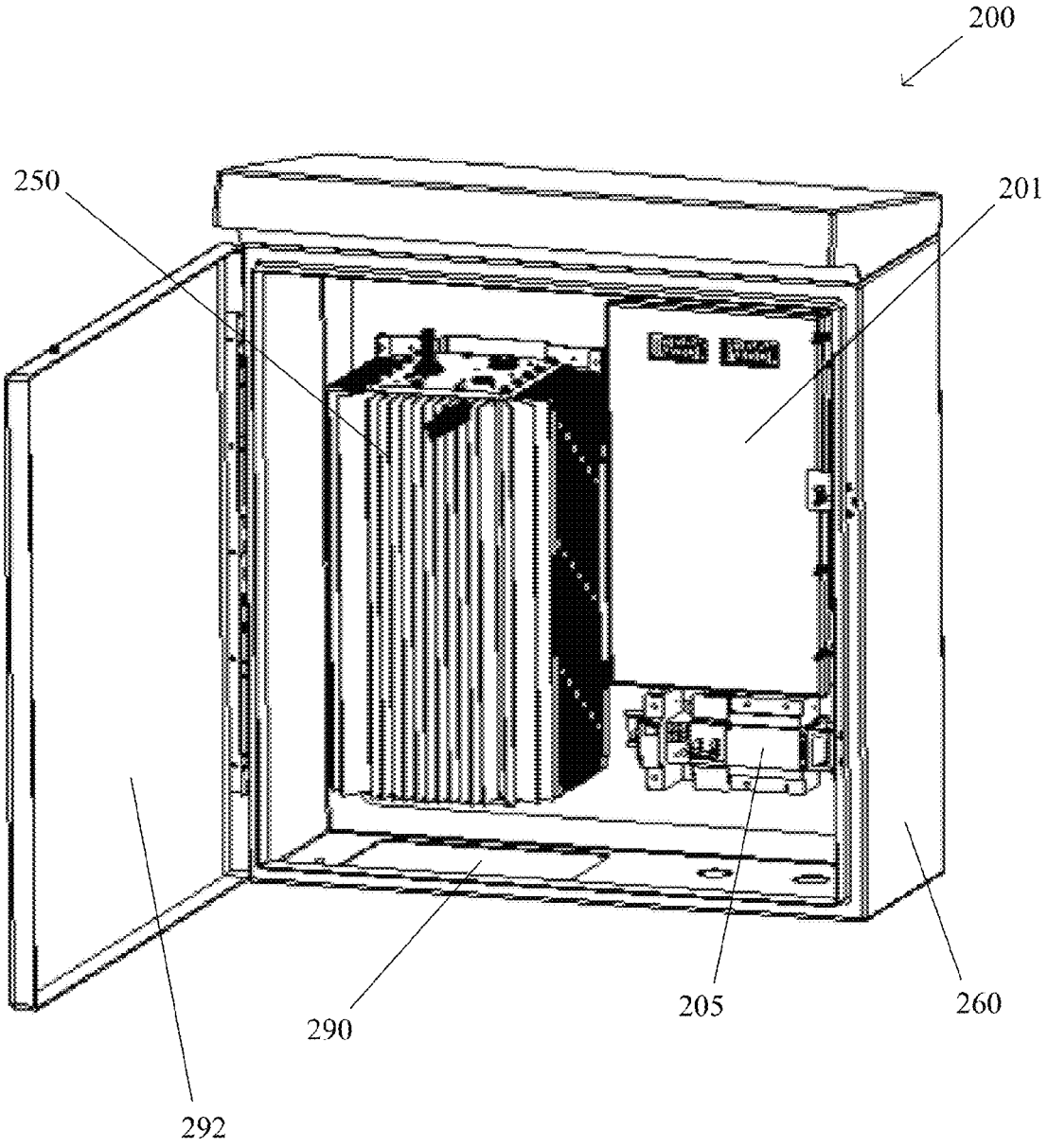
FIG. 5 shows schematically a second perspective view of the ICCP system of FIG. 2.

A perspective view of the cabinet 260 with an access panel 292 and a connection entry point 262 is shown in FIG. 3, as part of the ICCP system 200. An exploded view of the converter enclosure 250 shows the AC-DC power converter 204 of the ICCP system 200. With the access panel 292 open in FIG. 5, a ventilation screen 290 of the cabinet 260, the control box assembly 201, the Input-Output connection assembly 205, and the converter enclosure 250 of the ICCP system 200 are all visible. The access panel 392 provides a user with access to the control panel of the ICCP controller 210.

The rectifier's chassis is preferably made of extruded aluminum having a shape that allows mounting of the internal components, provides internal fins to optimize thermal transfer from the oil, and provides external fins for convection cooling. The end plates of the chassis are preferably implemented with rubberized O-rings to seal in the encapsulating oil. Wired connections are preferably realized via liquid-tight fittings.

The rectifier chassis fully encloses the circuitry with a contiguous metal surface, providing a Faraday cage for the containment of undesired electro-magnetic signals.

Rectifier maintenance is preferably simplified by utilizing external quick-disconnect electrical fittings and a slide-in mounting system. Thus, replacing a defective rectifier in the field is accomplished with minimally-trained personnel in a timely manner.

The other section houses customer input and output connection points, an external control interface assembly, an input circuit breaker, and input and output surge protection devices. This section of the cabinet is a sealed enclosure that features a gasket-lined access panel.

Overall system current is also limited via a control to the system's ICCP rectifier. This sets the maximum current the ICCP rectifier is capable of providing under any scenario. If system operating current is below this limit, the rectifier produces a well regulated voltage that compensates for variations in input voltage and output current. The ICCP current may be set either locally or remotely.

In some embodiments, an improved ICCP Rectifier control mechanism regulates the currents presented to individual anodes to provide significant advantages in terms of structure protection and the ongoing costs of system maintenance.

In some embodiments, the ICCP system utilizes a combination of a high-efficiency, switch-mode AC-DC rectifier, paired with high-efficiency, switch-mode post-regulators to provide closed-loop, precision control of both the total current delivered to the structure being protected, and the current delivered to individual anodes.

Figure 6:
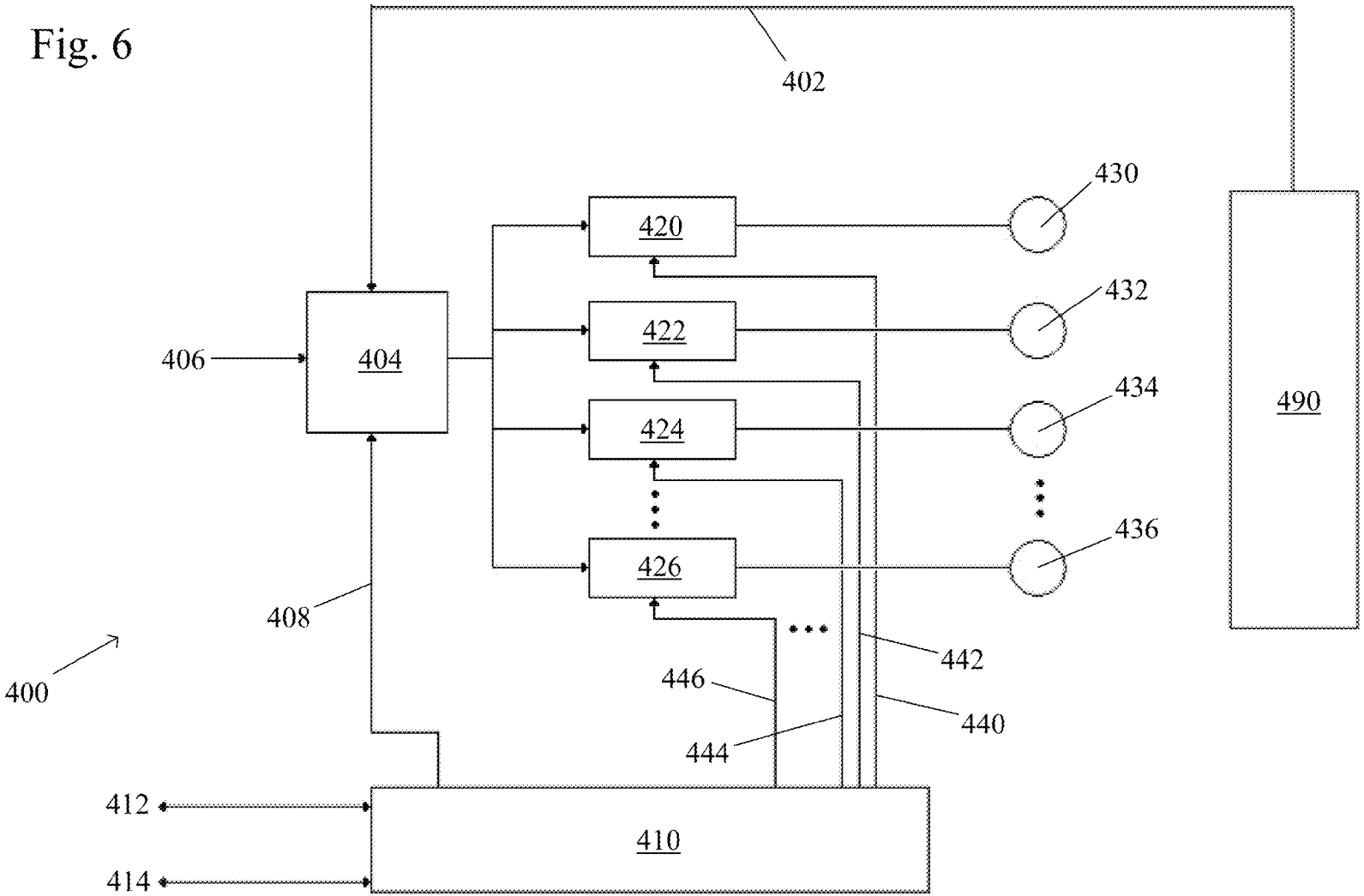
FIG. 6 shows a block diagram of an ICCP system in another embodiment of the present invention.

Referring to FIG. 6, the structure to be protected 490 is coupled by a remote cathode connection 402 to an AC-DC rectifier 404 of the ICCP system 400. The AC-DC rectifier 404 receives AC power from an AC power line 406 and provides a constant voltage or constant current output. The AC-DC rectifier 404 is coupled to an ICCP controller 410 by a control line 408. The ICCP controller 410 communicates through the control line 408 to set the maximum system current that is output by the AC-DC rectifier 404. The AC-DC rectifier is coupled in parallel to a set of n post-regulators, with the first post-regulator 420, second post-regulator 422, third post-regulator 424, and nth post-regulator 426 shown in FIG. 6. Each post-regulator 420, 422, 424, 426 is coupled to a current-emitting anode, with the first current-emitting anode 430, the second current-emitting anode 432, the third current-emitting anode 434, and the nth current-emitting anode 436 being shown in FIG. 6. The ICCP system 400 may include any number of current-emitting anodes, the number preferably being the minimum sufficient to adequately protect the structure to be protected 490. The ICCP controller 410 may be accessed by a user either through a remote user interface 412 or a local user interface 414. The ICCP controller 410 is individually coupled to each post-regulator 420, 422, 424, 426 by control lines 440, 442, 444, 446, respectively, to set a maximum anode current individually for each current-emitting anode 430, 432, 434, 436. In other embodiments, a serial digital bus is used to control the post-regulators.

The improved ICCP system allows the user to conduct an intensive survey of the structure being protected so as to ascertain the optimal injected current density (Amperes per unit area) across the entire structure. Individual anode currents are then preferably set via either a local or remote system interface. Individual anode current control is realized via voltage-to-current post-regulators implemented for each current-emitting anode.

The post-regulators compensate for seasonal variations in soil or water resistivity by adjusting the current output such that optimal current injection is realized on all portions of the protected structure. The rectifier voltage that supplies power to the post-regulators is preferably set to provide adequate voltage to overcome anticipated worst-case anode-to-structure resistivity. The post-regulators then trim delivered current to accommodate less than worst-case resistivity conditions.

The overall system current is also limited via a separate control to the system's ICCP rectifier. This sets the maximum current the ICCP rectifier provides under any scenario. If the system operating current is below this limit, the rectifier produces a well-regulated voltage that compensates for variations in input voltage and output current.

The ICCP controller also facilitates optimal system monitoring and maintenance, providing pertinent system operating parameters, which may include, but are not limited to, AC input power condition, DC output voltage, average delivered current, and operating temperature, to the system operator. This information is useful in ascertaining whether proper protection is being delivered to the structure.

An ICCP system preferably includes at least one of, but is not limited to, the following features:

A centralized power conversion system providing constant current delivery to multiple anodes located nearby the structure being protected.

Independently regulating the current delivered to each individual anode and limiting the maximum current delivered to the structure being protected.

Housing the rectifier and control circuitry in a compact, environmentally-secure manner that allows the ICCP system to be located in an optimal location relative to the structure to be protected in order to minimize copper conductor losses in the system.

A rectifier with extensive, automatic monitoring and reporting features.

An environmentally-hardened power conversion system providing closed-loop, constant-current delivery to the structure being protected.

A field-maintainable, high-frequency switch-mode rectifier.

Rectifier circuitry housed in an oil-filled enclosure providing thermal management, environmental isolation, electro-magnetic field containment and resistance to explosive vapors.

Control circuitry housed in a compact, environmentally-secure housing allowing it to be located in an optimal location in relation to the protected structure, so as to minimize copper conductor losses in the system.

Extensive, automatic closed-loop control, monitoring, and reporting features.

Electrical surge protection on the input power, the output power, and the control connection lines.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An impressed current cathodic protection system comprising:

a converter assembly comprising:

an AC-DC rectifier receiving an AC input on an AC input line from an AC power source and providing a DC output on a DC output line, the DC output having a constant voltage or a constant current; and a rectifier chassis enclosing and environmentally sealing the AC-DC rectifier;

an environmentally-sealed controller communicating with the AC-DC rectifier to set a maximum value for the constant voltage or the constant current of the DC output; and an environmentally-protected Input-Output connection assembly comprising a first high current lightning surge arrestor on the AC input line and a second high current lightning surge arrestor on the DC output line;

wherein a plurality of junctions electrically connect the converter assembly, the environmentally-sealed controller, and the environmentally-protected connection assembly.

2. The system of claim 1 further comprising:

a control box enclosure enclosing and environmentally sealing the environmentally-sealed controller;

an Input-Output connection enclosure enclosing and environmentally protecting the environmentally-protected Input-Output connection assembly; and a cabinet enclosing the converter assembly, the control box enclosure, and the Input-Output connection enclosure and providing solar shielding, resistance to tampering, and resistance to vermin.

3. The system of claim 2, wherein the cabinet comprises a gasket-lined access panel providing a user with local access to the environmentally-sealed controller.

4. The system of claim 2, wherein the cabinet comprises a ventilation screen.

5. The system of claim 2, wherein the converter assembly comprises external quick-disconnect electrical fittings and slides into the cabinet for mounting.

6. The system of claim 1 further comprising oil filling the space between the AC-DC rectifier and the rectifier chassis.

7. The system of claim 1, wherein the rectifier chassis fully encloses the AC-DC rectifier with a contiguous metal surface to provide a Faraday cage to contain electromagnetic signals from the AC-DC rectifier.

8. The system of claim 1, wherein the rectifier chassis is made of extruded aluminum.

9. The system of claim 1, wherein the AC-DC rectifier is a switch-mode type AC-DC rectifier.

10. The system of claim 1 further comprising at least one first high-frequency blocking choke on the AC input line and at least one second high-frequency blocking choke on the DC output line.

* * * * *